US008381843B1

(12) United States Patent
Lamontagne

(10) Patent No.: US 8,381,843 B1
(45) Date of Patent: Feb. 26, 2013

(54) WELL BORE REAMER

(76) Inventor: Bradley Allan Lamontagne, Wawota (CA)

( * ) Notice: Subject to any disclaimer, the term of this patent is extended or adjusted under 35 U.S.C. 154(b) by 0 days.

(21) Appl. No.: 13/437,588

(22) Filed: Apr. 2, 2012

Related U.S. Application Data

(60) Provisional application No. 61/530,610, filed on Sep. 2, 2011.

(51) Int. Cl.
*E21B 10/38* (2006.01)

(52) U.S. Cl. ..... 175/295; 175/266; 175/394; 175/306

(58) Field of Classification Search ..... 166/387, 166/179; 175/344, 230, 4.52, 295, 394, 406, 175/266

See application file for complete search history.

(56) References Cited

U.S. PATENT DOCUMENTS 2,717,764 A * 9/1955 Cannon ..... 175/295
5,232,058 A * 8/1993 Morin et al. ..... 175/73
2007/0289782 A1 * 12/2007 Clark et al. ..... 175/406

* cited by examiner

*Primary Examiner* — Daniel P Stephenson
*Assistant Examiner* — Yong-Suk (Philip) Ro
(74) *Attorney, Agent, or Firm* — Kyle R. Satterthwaite; Ryan W. Dupuis; Ade & Company Inc.

(57) ABSTRACT

A well bore reamer has an elongated body for coupling between members of a well string, a first set of cutting elements on the body at a fixed position, a second set of cutting elements on a sleeve closing around a sleeve carrying portion of the elongated body. The sleeve is slidable along a longitudinal axis of the body and rotatable thereabout. A lower clutch mechanism operates between the sleeve and the elongated body at a bottom end of the body's sleeve carrying portion to block rotation of the sleeve relative to the elongated body in a predetermined direction about the longitudinal axis under sliding of the sleeve into a lowered position adjacent said bottom end of the sleeve carrying portion.

20 Claims, 4 Drawing Sheets

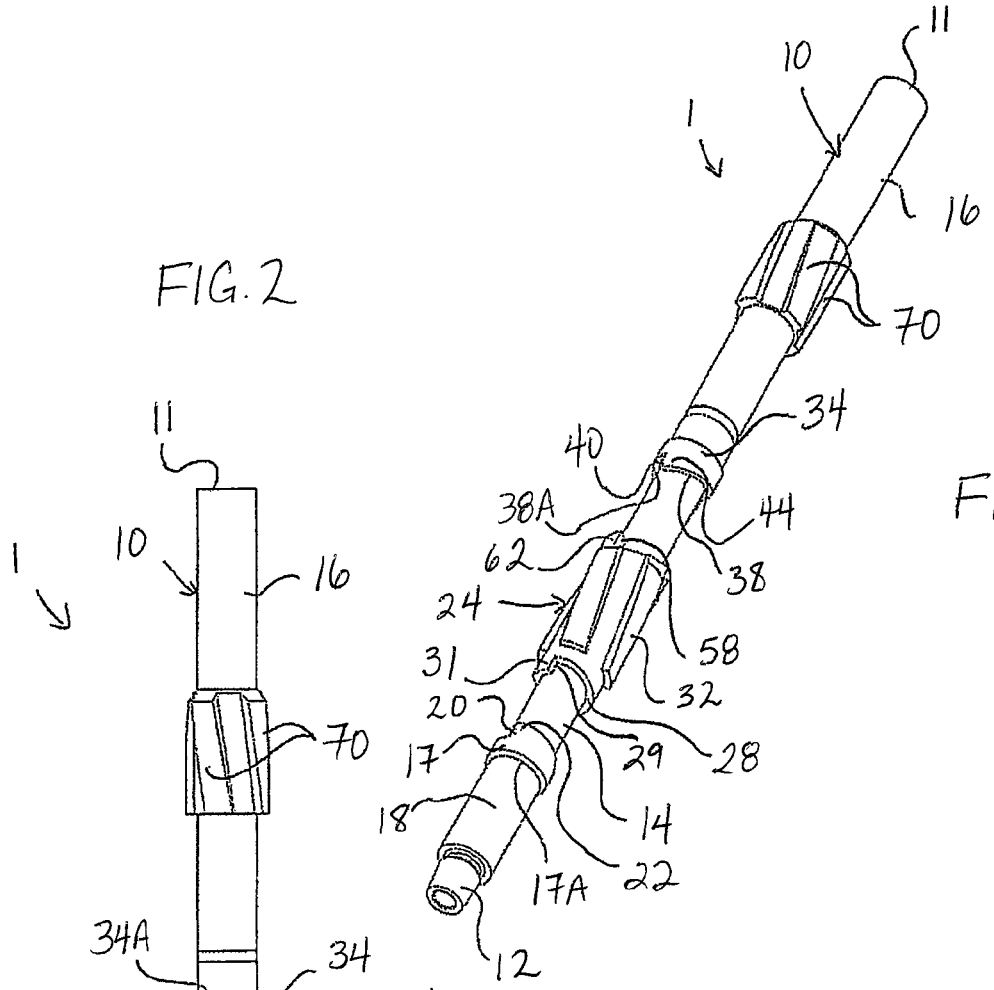
FIG. 1
FIG. 2
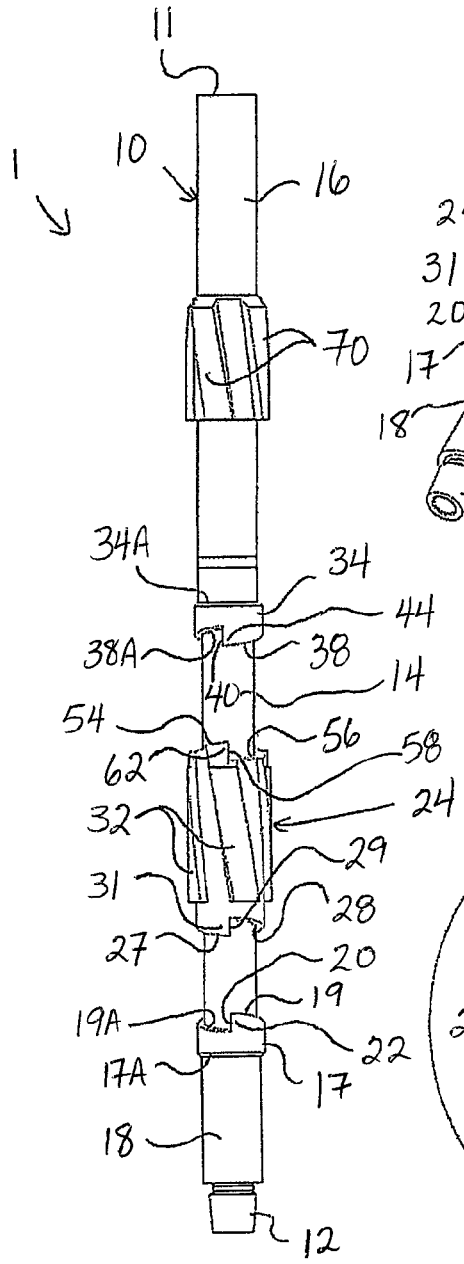
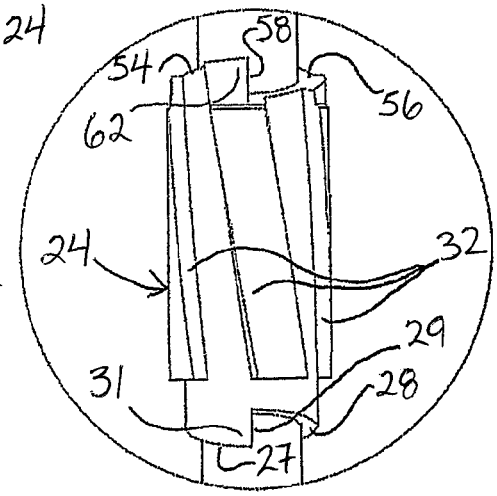
FIG. 3.

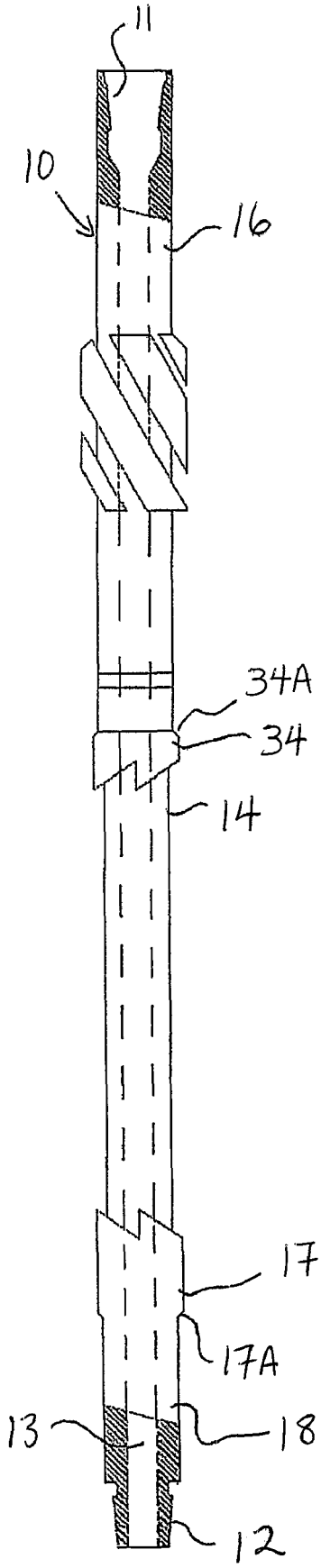
FIG. 4
FIG. 5
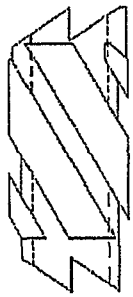

WELL BORE REAMER

CROSS REFERENCE TO RELATED APPLICATIONS

This application claims benefit under 35 U.S.C. 119(e) of U.S. Provisional Patent Application Ser. No. 61/530,610, filed Sep. 2, 2011.

FIELD OF THE INVENTION

The present invention relates generally to well bore reamers for enlarging portions of a drilled hole, and more particularly to a well bore reamer having a first set of cutting elements at a fixed position along its body and a second set of cutting elements on a sliding sleeve that rotates with the body when slid into engagement with clutch elements thereon.

BACKGROUND OF THE INVENTION

In the oil and gas industry, the purpose of a reamer is to size the well bore to a specific diameter. Reamers have been around probably as long as oil wells have been drilled. Standard reamers have fixed blades or rollers (roller reamers), with blades of certain lengths and number of sets of blades or rollers. Key seat wiper reamers are used to back ream a key seat that is created when a well deviates and the pipe wears into a softer formation.

Reamers used in horizontal wells size the well's diameter over a certain course length. Solid fixed reamers can be any number of blades, in any number of sets of blades a certain distance apart. Trouble with fixed reamers is when they are lowered into a deviated well bore with too much force, they tend to have elevated over pull to remove it from the dogleg. If the force applied is too great and the reamer does not go through the dogleg it may become stuck. When pulling up, the two and three fixed blade reamers have more over pull because all the blades have to be freed from their stuck positions at the same time.

Applicant has developed an improved reamer that provides multiple sets of cutting elements along its length, but arranges them in a unique configuration of fixed and movable sets to allow for easier removal in the above scenario.

SUMMARY OF THE INVENTION

According to a first aspect of the invention there is provided a well bore reamer comprising:

an elongated body having a longitudinal axis and adapted at opposing upper and lower ends therealong for coupling between members of a well string for rotation and displacement therewith in a well bore;

a first set of cutting elements provided on the elongated body at a fixed position along the longitudinal axis thereof and presenting a first set of cutting edges;

a second set of cutting elements provided on a sleeve closing around a sleeve carrying portion of the elongated body that is disposed between the lower end of the elongated body and the fixed position of the first set of cutting elements thereon, the sleeve being slidable along the longitudinal axis and rotatable thereabout on the sleeve carrying portion of the elongated body and each set of cutting elements presenting cutting edges radially outward from the elongated body; and a lower clutch mechanism operable between the sleeve and the elongated body at a bottom end of the sleeve carrying portion of the elongated body to block rotation of the sleeve relative to the elongated body in at least one direction about the longitudinal axis under sliding of the sleeve into a lowered position adjacent said bottom end of the sleeve carrying portion.

Preferably there is provided an upper clutch mechanism operable between the sleeve and the elongated body at a top end of the sleeve carrying portion of the elongated body to block rotation of the sleeve relative to the elongated body in the at least one direction about the longitudinal axis under sliding of the sleeve into a raised position adjacent said top end of the sleeve carrying portion.

In one embodiment, each clutch mechanism is arranged to block rotation of the sleeve relative to the elongated body in only the one direction about the longitudinal axis.

Preferably the first set of cutting elements comprises a first set of ribs spaced apart from one another around a circumference of the elongated body, projecting outward therefrom and extending therealong.

Preferably the first set of ribs extend along the elongated body on helical paths about the circumference thereof.

Preferably the second set of cutting elements comprises a second set of ribs spaced apart from one another around a circumference of the sleeve, projecting outward therefrom and extending therealong.

Preferably the second set of ribs extend along the sleeve on helical paths about the circumference thereof.

Preferably each cutting element twists downwardly along and around about the longitudinal axis in a direction opposite the predetermined direction of rotation of the sleeve and body together when the lower clutch mechanism is engaged.

Preferably the clutch is arranged to stop relative rotation of the sleeve around the elongated body at an angular position in which the second set of cutting elements on the sleeve and the first set of cutting elements on the elongated body are staggered thereabout.

Preferably a length of the sleeve carrying portion along the longitudinal axis is at least as great as a combined length of a span of the first cutting elements along the longitudinal axis and a span of the second cutting elements along the longitudinal axis.

Preferably the length of the sleeve carrying portion along the longitudinal axis exceeds the combined length of the span of the first cutting elements along the longitudinal axis and the span of the second cutting elements along the longitudinal axis.

Preferably the first set of cutting elements are spaced a distance along the longitudinal axis from the sleeve carrying portion of the elongated body.

Preferably the distance exceeds a length spanned by the first set of cutting elements along the longitudinal axis.

Preferably a milling area of the reamer, measured along the longitudinal axis from a bottom end of the second set of cutting elements on the sleeve, when the sleeve is engaged at the lower clutch mechanism, to a top end of the first set of cutting elements has a length of at least 33.5-inches, and preferably between 33.5 and 35-inches long, for example 34.5-inches.

The number of blades in each set may be between 4 and 6 blades for some embodiments, but may also have blades numbering less or greater than this range.

Preferably the ribs defining the second set of cutting elements include at least one rib extending fully to the bottom end of the sleeve at a respective lower clutch jaw of the sleeve.

Preferably the ribs of the second set of cutting elements include at least one rib extending fully to the top end of the sleeve at a respective jaw of the upper clutch mechanism.

Preferably the ribs of the second set of cutting elements include ribs extending fully to the top and bottom ends of the sleeve at respective jaws of the upper and lower clutch mechanisms.

Preferably the ribs of the second set of cutting elements include one or more first ribs extending fully to the top end of the sleeve at one or more respective upper clutch jaws of the sleeve and one or more second ribs extending fully to the bottom end of the sleeve at one or more respective lower clutch jaws of the sleeve.

Preferably at least one of the ribs has an end portion that located adjacent the top or bottom end of the sleeve and is thicker than an intermediate portion of the rib.

Preferably there is provided a tungsten carbide coating applied to the intermediate portion of the rib, the tungsten carbide coating reaching further outward from the sleeve than the thicker end portion of the rib.

Surface treatment may be applied to the elongated body at a circumferential surface of one of more clutch jaws thereon to define additional cutting edges at said surface.

BRIEF DESCRIPTION OF THE DRAWINGS

In the accompanying drawings, which illustrate exemplary embodiments of the present invention:

FIG. 1 is a perspective view of a well bore reamer of the present invention.

FIG. 2 is a side elevational view of the well bore reamer of FIG. 1.

FIG. 3 is a close up view of a sliding sleeve of the well bore reamer of FIG. 2.

FIG. 4 is a partially cut away side elevational view of a body of another well bore reamer of the present invention.

FIG. 5 is a side elevational view of the sliding sleeve of the well bore reamer of FIG. 4.

DETAILED DESCRIPTION

Figure 6:
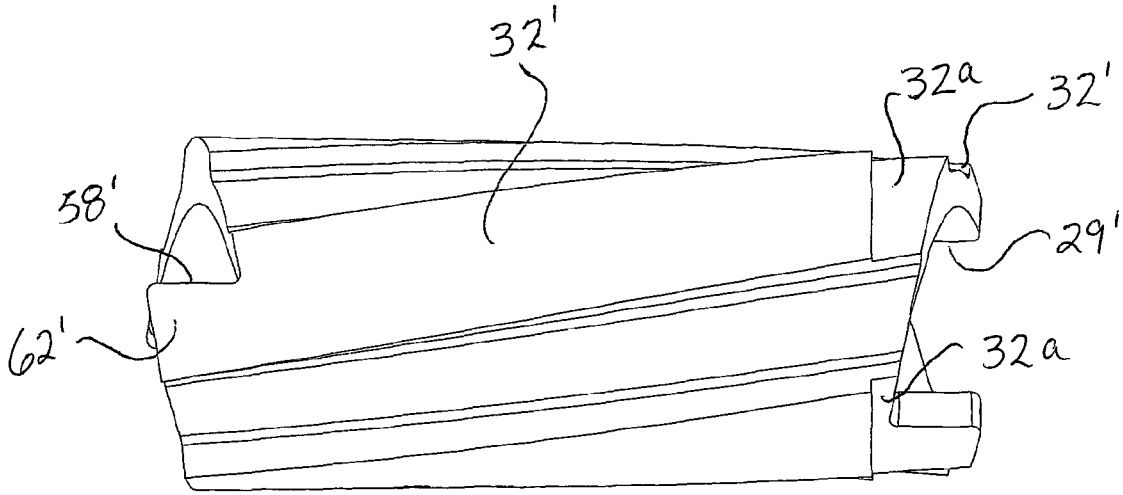
FIG. 6 is a side view of a sliding sleeve similar to that of FIG. 3, but having longer cutting blades extending fully to the ends of the sleeve.

FIGS. 1 to 3 illustrate a reamer 1 according to one embodiment of the present invention.

The reamer 1 features an elongated centrally bored body or mandrel 10, which may be one piece of metal, having at its upper end a conventional threaded box 11 for engaging and holding the pin end of a drill pipe or stem (not shown), and having at its lower end a conventional threaded pin 12 for engaging and holding a box of a drill pipe or stem (not shown).

The purpose of the central bore 13 through the body 10, is to allow circulation of fluid through the drill pipe and the device. The body 10 has an exteriorly circumferentially reduced longitudinal portion 14 intermediate its ends, leaving at the upper and lower ends, respectively, of the body 10 two end portion 16 and 18 of larger outer diameter. The lower end of the reduced portion 14 has a gripping shoulder 17, slightly larger circumferentially than the lower end portion 18, and ending with a beveled edge 17A transitioning to the respective smaller diameter end portion 18. The top face of the shoulder 17 has two depending guide faces 19 and 19A winding left-handedly around and downwardly along the reduced portion 14, perpendicular thereto, and ending abruptly at their lower ends in two vertical faces 20 (only one of which is visible in the drawings) that are parallel to the longitudinal axis of the body and that each interconnect the bottom end of one guide face to the top end of the other, thereby forming two upwardly projecting ratchet-type jaws 22 (only one of which is visible in the drawings), for the purposes more fully explained hereinbelow.

A longitudinal tubular sleeve 24, with its outer periphery equal to the periphery of the shoulder 17, has a bore slightly larger than the outer periphery of the reduced portion 14, and has a length less than the length of the reduced portion 14, and is slidably mounted thereon.

The lower end of the sleeve 24 has two upwardly projecting cuts or guide faces 27 and 28 through the wall of the sleeve 24 and that wind left-handedly around and upwardly along the reduced portion 14, perpendicular thereto. These end abruptly at their upper ends in two oppositely disposed vertical faces 29 that are parallel to the longitudinal axis of the body and each interconnect the bottom end of one guide face to the top end of the other, thereby forming a pair of oppositely disposed downwardly projecting ratchet-type jaws 31 (only one of which is visible in the drawings) for co-acting with the jaws 22 to rotate the sleeve 24 with the body 10 as the body 10 is rotated to the right (i.e. clockwise as viewed from above). One face 29 is seen in FIG. 1, cut through the wall of the sleeve 24 to define one of the downwardly projecting ratchet-type jaws 31 for positive engagement with one of the jaws 22 on the body at the lower end of the reduced diameter portion 14. The guide faces on the sleeve and body conform to the same winding path around the reduced diameter portion 14 of the body so as to fit flush together when the jaws are engaged for engagement of the longitudinal faces of the jaws together over their full height along the longitudinal axis. The sleeve 24 may be placed on the reduced portion 14 by cutting it longitudinally (not shown) in two or more places, and welding or otherwise reattaching the cuts together, forming one integral unit after the sleeve 24 is slidably in place on the reduced portion 14.

A selected number of spaced-apart ribs 32 are formed on the periphery of the sleeve 24 and project outwardly therefrom a selected distance to present cutting edges radially outward from all parts of the body 10, thus defining a set of cutting blades. The configuration of each illustrated rib 32 is such that it has a cross-section of substantially uniform width as it projects outward from the wall of the sleeve 24 and ends in a substantially flat or slightly convex face. The ribs 32 are helically formed or wound on the sleeve on left-hand helical paths therearound, thus sloping downward on the sleeve in a direction opposite the rotation of the sleeve with the body when the jaws on the sleeve and body are engaged together. This opposing twist of the blades allows the blades to float on an under-gauge well bore diameter (i.e. narrow section of the well bore) to mill it away, as opposed to being drawn therethrough by blades twisting in the same direction as the drill string. The ribs 32 may be formed as integral parts of the sleeve through machining processes, or be formed separately from the sleeve 24 and welded thereto (not shown) if desired. The ribs 32 may be hardened or otherwise treated to prevent excessive wear. For example, tungsten carbide surface treatment may be applied to the ribs 32.

The upper ends of the reduced body portion 14 and sleeve 24 are configured similarly to their bottom ends to likewise form mating ratchet jaws that engage when the sleeve slides to the upper end of the reduced portion to form a clutch that will rotate the sleeve with the body together under right-handed rotation of the string in which the body is incorporated. Accordingly, the upper end of the reduced portion 14 has its own gripping shoulder 34, of slightly larger circumferentially than the upper end portion 16, and ending with a beveled edge 34A transitioning to the respective smaller diameter end portion 16. The bottom face of the shoulder 34 has two rising guide faces 38 and 38A winding right-handedly around and upwardly long the reduced portion 14, perpendicular thereto, and ending abruptly at their upper ends in two vertical faces 40 that are parallel to the longitudinal axis of the body in a radial plane thereof (only one of which is visible in the drawings) and that each interconnect the top end of one guide face to the bottom end of the other, thereby forming two upwardly projecting ratchet-type jaws 44 (only one of which is visible in the drawings), as seen in FIGS. 1 and 2.

The upper end of the sleeve 24 has two downwardly projecting cuts or guide faces 54 and 56 through the wall of the sleeve 24 that right-handedly wind around and upwardly along the reduced portion 14, perpendicular thereto. These end abruptly at their lower ends in two oppositely disposed vertical faces 58 (only one of which is visible in the drawings) forming a pair of oppositely disposed downwardly projecting ratchet-type jaws 62 (only one of which is visible in the drawings) for co-acting with the jaws 44 to rotate the sleeve 24 with the body 10 as the body 10 is rotated to the right (i.e. clockwise as viewed from above). One face 58 is seen in FIG. 1, cut through the wall of the sleeve 24 defining one of the downwardly projecting ratchet-type jaws 62 for positive engagement with one of the jaws 44. The cutting blades on the sleeve may extend fully between the clutch defining jaw-like ends, and even extend onto these jaw-forming end portions of the sleeve, for example as shown in the embodiment of FIG. 6.

On the upper end portion 16 of the body 10, at a distance spaced above the shoulder 34 between this portion and the reduced circumference portion 14 slidably carrying the sleeve 24, a set of stationary blades 70 are rigidly fixed to the body 10. The blades themselves 70 may have generally the same structure and configuration as the rib-defined blades 32 on the sleeve 24, but are not movable relative to the body due to their rigid mounting thereto, unlike the sleeve's blade's 32 than can slide along the body with the sleeve and rotate relative to the body on the sleeve (except for when the jaws of the clutch mechanism are engaged at the top or bottom of the sleeve carrying portion 14 are engaged to block rotation of the sleeve in a left-hand direction (counterclockwise from above) relative to the body 10).

The angular positions of stop faces 29, 58 on the clutch jaws 31, 62 of the sleeve 24 about the longitudinal axis thereof relative to the angular positions of the ribs or blades 32 about that axis is such that when any of these stop faces 29, 58 abuts against one of the stop faces 20, 40 on the clutch jaws 22, 44 on the body 10, the blades 32 on the sleeve are staggered relative to the fixed blades 70 on the body. For example, using the top end of each blade as a marker of its angular position about the reamer's longitudinal axis at any given point in time, when a pair of sleeve and body clutch jaws are engaged to rotate the sleeve with the body, the top of each sleeve-carried blade 32 generally aligns around the axis with the top end of a corresponding gap between two adjacent blades 70 of the fixed blade set further up the body. Looking down the reamer from the box end, the blades of the sleeve are in view from the slots of the top fixed blades, so when the reamer is lowered into the well bore, there is very little or no area that is not touched by the blades. This is only important when raising or lowering the reamer without rotation, not during the actual reaming process. The blade length and twist are selected to provide this full-circumference coverage of the blades around the tool body.

The above reamer incorporates elements from elements from sliding-sleeve key seat wipers, such as those disclosed in U.S. Pat. Nos. 2,717,764 and 2,790,623, and combines them in a unique manner with a fixed set of blades further up a shared tool body to provide functional advantages over conventional reamer designs in situations where the reamer is forced into a dogleg with excessive force and has the potential of excessive over pull being required for removal. With the present invention, when over pull is exerted, the fixed reamer blades 70 are pulled free first, with the movable set of blades 32 remaining stuck due to the relative sliding allowed between the sleeve and mandrel. Once the bottom of the sleeve-carrying portion of the mandrel reaches the bottom of the sleeve under continued pulling of the string, the sleeve-carried blades 32 are then withdrawn as well. This relative sliding of the lower blade set in this situation means that only one set of stuck blades is being pulled out a time, and thus the over pull force required to dislodge the stuck reamer is reduced compared to trying to pull out two stuck sets of fixed blades on a prior art multi-blade reamer. For example, in the case of a reamer with two blade sets of approximately the same size and configuration, the required maximum over pull force required to free the reamer would be expected to be about half in the case of an upper fixed blade set and a lower slidable blade set compared to a reamer with two sets of fixed blades. Testing of a prototype with fixed and sliding blade sets of similar size found this to be the case. In two test cases where very excessive downward force was used when running the reamer into the well bore by running it in too fast and applying too much of the weight of the pipe above the reamer, thus tending to push the reamer around a dogleg and causing it to get stuck, the reamer was pulled free in less than an hour without the use of spotting oil, acid or shooting off to install bumper subs and jars. This presents the potential for incredible cost savings in retrieving a stuck reamer.

With an upper clutch mechanism provided by the matable jaws at the top ends of the sleeve and the mandrel's sleeve carrying portion and a lower clutch mechanism provided by the matable jaws at the bottom ends of the sleeve and the mandrel's sleeve carrying portion, the sleeve-carried blades can be driven for rotation during lowering or raising of the string when an obstruction or deviation blocks movement of the sleeve therepast, and thus slides the sleeve relatively along the sleeve-carrying mandrel portion to a respective end thereof. The reamer thus benefits from the functionality of two blade sets without the difficulty of trying to simultaneously dislodge both blade sets to free the reamer should it become stuck.

In the illustrated embodiments, the clutch engages only in one predetermined direction of relative rotation between the sleeve and the tool body, by employing a clutch of similar configuration to that disclosed in U.S. Pat. No. 2,790,623. In other embodiments, the clutch may be engagable in both directions of rotation, for example in a configuration like that shown in U.S. Pat. No. 2,717,764. Engaging the sleeve in only one direction to allow free relative rotation between the sleeve and tool body in the other direction can be advantageous in preventing the potential for loosening or decoupling of connections in the string under trapped-torque conditions. However, a single-direction clutch may be problematic in other situations, for example where the reamer needs to be backed off, setting reverse torque into the string of pipe and firing an explosive charge at a depth where the pipe is free, the sleeve-carried reamer blades will not engage in this reverse direction of rotation. Accordingly, a dual-direction clutch may be used in other embodiments to accommodate such situations. However, the design of the tool with both fixed and sliding blades reduces the likelihood of the tool becoming stuck, so that such a procedure would not be required, thus avoiding the need for engagement of the clutch in the second direction. Also, if the reamer does become stuck, the stuck condition of the fixed blades could hold the reverse torque for backing off of the reamer.

FIGS. 4 and 5 show a reamer of another embodiment similar to that described above, but with some differences, including the helical configuration of the surfaces winding around the sleeve-carrying portion of reduced diameter 14, the spacing of the jaws around each end of the sleeve 24 and sleeve carrying mandrel portion 14, the smaller pitch of the blades relative to the longitudinal axis of the mandrel, and the sleeve being of greater outer diameter at the top end than at the bottom.

FIG. 6 shows the sliding sleeve of another embodiment which is, similar to that of FIG. 1, except that in addition to a respective one of the four blade's 32' being present at each stop face 29' at the top-end of the sleeve (like in the first embodiment), another respective one of the four blade's is present at each stop face 58' at the bottom end of the sleeve. The portion of the respective lower clutch jaw 62' defining each stop face 58' at the bottom of the sleeve is thus of greater thickness in the third embodiment than in the first embodiment due to the presence of a blade 32' at this stop face 58'. The longer blade length reaching fully to the bottom end of the sleeve not only increases the cutting capacity of the tool by increasing the overall length of cutting edges on the tool, but also increases the strength of the lower clutch jaws on the sleeve by this thickening of the sleeve's lower clutch jaws to widen the contact faces where the sleeve's lower clutch jaws abut against the lower clutch jaws of the tool body.

Due to the helical path of the blades around and along the sleeve, this presence of blades at the stop faces of the clutch jaws means that the third embodiment also differs from the first in that the position of each stop face at the top end of the sleeve is offset around the sleeve axis from a respective stop face at the bottom of the sleeve. That is, the diametrically opposite stop faces at the top end of the sleeve are angularly offset around the sleeve axis from the diametrically opposite stop faces at the bottom of the sleeve in order to situate each stop face at a respective bladed portion of the sleeve's circumference. The sleeve of FIG. 6 features four blades, each of which defines one respective stop face of the sleeve. Thus, the bottom end of one blade defines a stop face at the bottom end of the sleeve, but not at the top end of the sleeve, while the next blade around the sleeve's circumference is of the opposite configuration, defining a stop face at the top end of the sleeve but not at the bottom end thereof. The sleeve of FIG. 6 features a stepped-down blade thickness 32*a* approaching the top end of the sleeve, where the blade still provides a clutch jaw thickness greater than the sleeve wall thickness between the blade, but with the reduced thickness 32*a* upper end portion of the blade being of smaller thickness than the uniform-thickness remainder of the blade.

Figure 7:
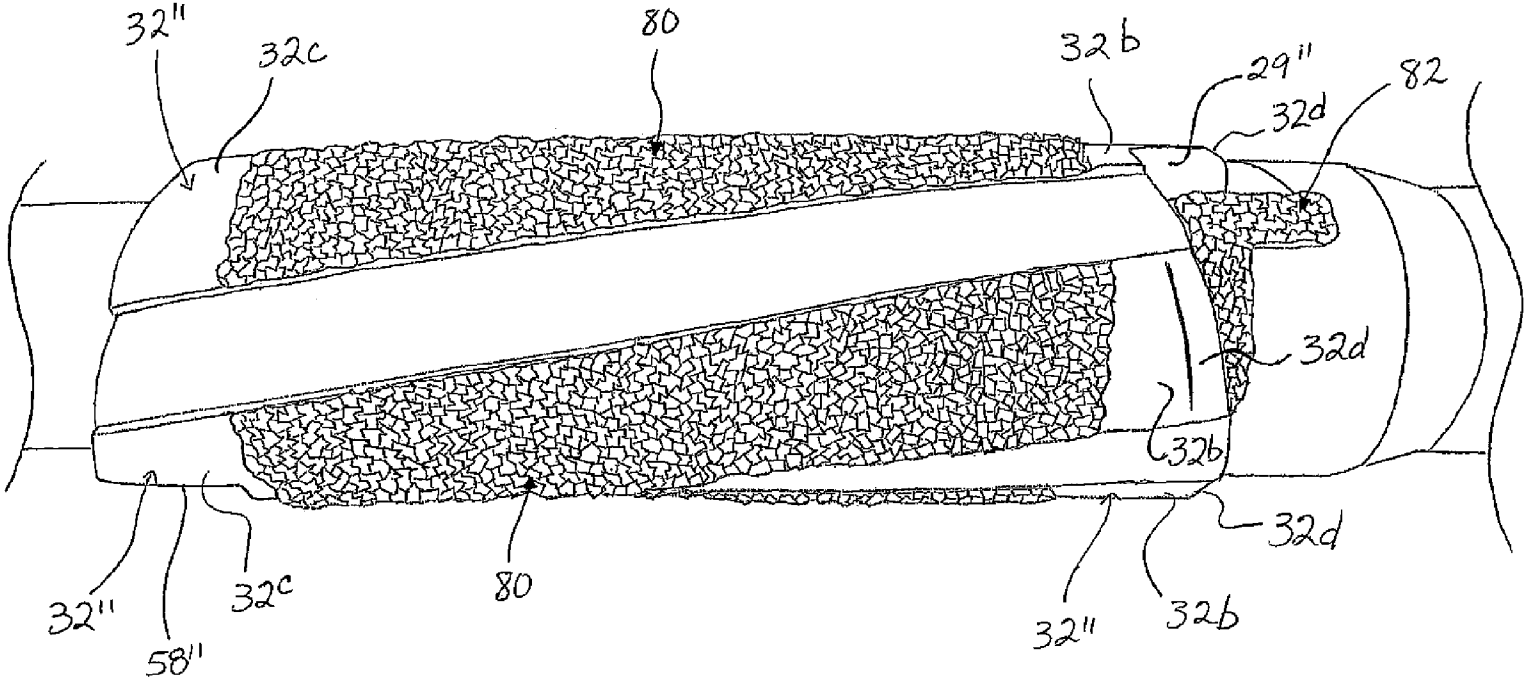
FIG. 7 is a partial side elevational view of well bore reamer featuring tungsten carbide abrading pieces applied to blades of the sleeve.

FIG. 7 illustrates a reamer with another sleeve design, where like the FIG. 6 embodiment, the blades 32" extend fully to both ends of the sleeve, except that each blade increases in thickness at the upper end 32*b* thereof. Tungsten carbide pieces, schematically shown at 80, are fixed on the blades to span the full width and a substantial length a uniform-thickness remainder 32*c* of the blade 32" below the thicker upper end 32*b* thereof. The combined effective thickness of the uniform-thickness blade portion and the tungsten carbide treatment applied thereon slightly exceeds the thickness of the untreated upper blade portion 32*b*. The thicker upper blade portions 32*b* thus increase the sleeve thickness at the contact faces 29" of the upper clutch jaws for improved clutch strength, without projecting radially outward beyond the working, cutting or abrading surfaces provided by the carbide. The uniform thickness portion 32*c* of each blade continues past the lower end of its carbide-treated area to fully reach the lower end of the sleeve, thus providing greater sleeve thickness at the contact faces 58" of the lower clutch jaws compared to the un-bladed portions of the sleeve for improved clutch strength.

The FIG. 7 embodiment also illustrates that application of tungsten carbide or other surface treatment may be applied to the circumferential, radially outward facing surface of one or more of the clutch jaws, for example as shown by tungsten carbide treatment 82 at the upper clutch jaws 44. Although not necessarily apparent from the Figure, the radial extent reached by the carbide 82 on the clutch jaws 44 is equal or close to that of the carbide 80 on the blades 32". That is, the jaw carbide 82 reaches radially outward past the radial extent reached by the thickened upper end 32*b* of each blade. As shown at 32*d*, each blade may each taper down in thickness from the thicker blade portion 32*b* to the top end of this blade. On the blades located at the upper clutch jaws, the length of the taper is less than the height of the contact face 29" of the clutch jaw so that the majority of the contact face benefits from the added width provided by the thick portion 32 of the blade.

It will be appreciated that directional terms such top, bottom, upper, lower, upward, downward, depending, rising are used in terms of the illustrated vertical or sloped orientation of the reamer in the figures, and are not intended to limit use of the reamer or the scope of the claims to a particular orientation, but rather are used as positional terms to differential different ends of the reamer or directions therealong from one another. Accordingly, the terms bottom and lower are used in relation to a part or feature disposed further into a wellbore from the surface, i.e. from the end of the wellbore from which the string enters the wellbore, compared to a top or upper part or feature nearer the surface, regardless of whether the bottom or lower part or feature is actually at a lower elevation than the upper part or feature at the reamers actual position or orientation at a particular moment.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A well bore reamer comprising:

an elongated body having a longitudinal axis and adapted at opposing upper and lower ends therealong for coupling between members of a well string for rotation and displacement therewith in a well bore;

a first set of cutting elements provided on the elongated body at a fixed position along the longitudinal axis thereof and presenting a first set of cutting edges;

a second set of cutting elements provided on a sleeve closing around a sleeve carrying portion of the elongated body that is disposed between the lower end of the elongated body and the fixed position of the first set of cutting elements thereon, the sleeve being slidable along the longitudinal axis and rotatable thereabout on the sleeve carrying portion of the elongated body and each set of cutting elements presenting cutting edges radially outward from the elongated body; and a lower clutch mechanism operable between the sleeve and the elongated body at a bottom end of the sleeve carrying portion of the elongated body to block rotation of the sleeve relative to the elongated body in a predetermined direction about the longitudinal axis under sliding of the sleeve into a lowered position adjacent said bottom end of the sleeve carrying portion;

wherein a length of the sleeve carrying portion along the longitudinal axis is at least as great as a combined length of a span of the first cutting elements along the longitudinal axis and a span of the second cutting elements along the longitudinal axis, whereby pulling of the reamer from a dogleg in which the reamer has been sufficiently forced to lodge the first and second sets of cutting elements in respective stuck positions will initially pull only the first set of cutting elements from the respective stuck position due to relative sliding between the sleeve and the elongated body, until the elongated body is pulled far enough to engage the lower clutch mechanism against the sleeve and thus begin also pulling the second set of cutting elements from the respective stuck position.

2. The well bore reamer of claim 1 comprising an upper clutch mechanism operable between the sleeve and the elongated body at a top end of the sleeve carrying portion of the elongated body to block rotation of the sleeve relative to the elongated body in the predetermined direction about the longitudinal axis under sliding of the sleeve into a raised position adjacent said top end of the sleeve carrying portion.

3. The reamer of claim 2 wherein the second set of cutting elements comprises ribs spaced apart from one another around a circumference of the sleeve, projecting outward therefrom and extending therealong, including at least one rib extending fully to the top end of the sleeve at a respective jaw of the upper clutch mechanism.

4. The reamer of claim 2 wherein the second set of cutting elements comprises ribs spaced apart from one another around a circumference of the sleeve, including ribs extending fully to the top and bottom ends of the sleeve at respective jaws of the upper and lower clutch mechanisms.

5. The reamer of claim 2 wherein the second set of cutting elements comprises ribs spaced apart from one another around a circumference of the sleeve, including one or more first ribs extending fully to the top end of the sleeve at one or more respective upper clutch jaws of the sleeve and one or more second ribs extending fully to the bottom end of the sleeve at one or more respective lower clutch jaws of the sleeve.

6. The well bore reamer of claim 1 wherein the first set of cutting elements comprises ribs spaced apart from one another around a circumference of the elongated body, projecting outward therefrom and extending therealong.

7. The reamer of claim 6 wherein the ribs extend along the elongated body on helical paths about the circumference thereof.

8. The reamer of claim 7 wherein each helical path twists downwardly along and around about the longitudinal axis in a direction opposite the predetermined direction of rotation for which the lower clutch mechanism is arranged to rotate of the sleeve and body together.

9. The well bore reamer of claim 1 wherein the second set of cutting elements comprises ribs spaced apart from one another around a circumference of the sleeve, projecting outward therefrom and extending therealong.

10. The reamer of claim 9 wherein the ribs extend along the sleeve on helical paths about the circumference thereof.

11. The reamer of claim 9 wherein the ribs defining the second set of cutting elements include at least one rib extending fully to the bottom end of the sleeve at a respective lower clutch jaw of the sleeve.

12. The reamer of claim 9 wherein at least one of the ribs has an end portion that located adjacent the top or bottom end of the sleeve and is thicker than an intermediate portion of the rib.

13. The reamer of claim 12 comprising a tungsten carbide coating applied to the intermediate portion of the rib, the tungsten carbide coating reaching further outward from the sleeve than the thicker end portion of the rib.

14. The reamer of claim 1 wherein each cutting element twists downwardly along and around the longitudinal axis in a direction opposite the predetermined direction of rotation for which the lower clutch mechanism is arranged to rotate the sleeve and body together.

15. The reamer of claim 1 wherein the clutch is arranged to stop relative rotation of the sleeve around the elongated body at an angular position in which the second set of cutting elements on the sleeve and the first set of cutting elements on the elongated body are staggered thereabout.

16. The reamer of claim 1 wherein the length of the sleeve carrying portion along the longitudinal axis exceeds the combined length of the span of the first cutting elements along the longitudinal axis and the span of the second cutting elements along the longitudinal axis.

17. The reamer of claim 1 wherein the first set of cutting elements are spaced a distance along the longitudinal axis from the sleeve carrying portion of the elongated body.

18. The reamer of claim 17 wherein the distance exceeds a length spanned by the first set of cutting elements along the longitudinal axis.

19. The reamer of claim 1 comprising surface treatment applied to the elongated body at a circumferential surface of one of more clutch jaws thereon to define additional cutting edges at said surface.

20. A method of pulling free a wellbore reamer that has become stuck in a wellbore dogleg with first and second sets of cutting elements of said reamer respectively stuck in first and second stuck positions in said dogleg, the method comprising:

pulling on an elongated body of the reamer while the first and second sets of cutting elements of said reamer are stuck in the first and second stuck positions in the dogleg, the first set of cutting elements being provided at a fixed position along a longitudinal axis of said elongated body and the second set of cutting elements being provided on a sleeve that closes around a sleeve carrying portion of the elongated body that is disposed between a lower end of the elongated body and the fixed position of the first set of cutting elements thereon, the sleeve being slidable along the longitudinal axis and rotatable thereabout on the sleeve carrying portion of the elongated body and each set of cutting elements presenting cutting edges radially outward from the elongated body;

wherein said pulling of the elongated body comprises:

(i) initially pulling the first set of cutting elements out of the first stuck position in the dogleg while relative sliding between the elongated body and sleeve leaves the second set of cutting elements in the second stuck position in the dogleg; and (ii) having freed the first set of cutting elements from the first stuck position, and with the second set of cutting elements still in the second stuck position, pulling the elongated body far enough to bring a clutch feature on the elongated body at a lower end of the sleeve carrying portion thereof up against a corresponding clutch feature on the sleeve at a bottom end thereof; and (iii) having brought the clutch feature of the elongated body up against the corresponding clutch feature at the bottom end of the sleeve, pulling the elongated body further and thereby pulling the second set of cutting elements out of the second stuck position.

* * * * *